US005795027A

United States Patent [19]

Howard et al.

[11] Patent Number: 5,795,027

[45] Date of Patent: Aug. 18, 1998

[54] FURNITURE MADE OF FOLDABLE MATERIALS

[75] Inventors: John R. Howard, Northwoods; Robert W. Machacek, Lombard, both of Ill.

[73] Assignee: NEWance, Inc., Addison, Ill.

[21] Appl. No.: 808,636

[22] Filed: Feb. 28, 1997

[51] Int. Cl.[6] ..... A47C 7/00

[52] U.S. Cl. ..... 297/440.12; 297/440.1

[58] Field of Search ..... 297/440.12, 440.1, 297/445.1, 440.15, 440.22

[56] References Cited

U.S. PATENT DOCUMENTS

| | | | |
|---|---|---|---|
| 2,912,702 | 11/1959 | Mackenzie | 297/440.12 X |
| 3,250,570 | 5/1966 | Smith et al. | 297/440.12 |
| 3,312,503 | 4/1967 | Suzuki | 297/440.12 |
| 3,331,634 | 7/1967 | Harrison, Jr., | 297/440.12 |
| 3,695,703 | 10/1972 | Notko | 297/440.12 |
| 3,871,726 | 3/1975 | Stegner | 297/440.12 X |
| 4,340,251 | 7/1982 | Geoffroy-Dechaume | 297/440.12 |
| 4,875,737 | 10/1989 | Cardenas | 297/440.12 |

*Primary Examiner*—Milton Nelson, Jr.

*Attorney, Agent, or Firm*—Patnaude, Videbeck & Marsh

[57] ABSTRACT

Blanks of stiff material such as corrugated cardboard are foldable to form an ottoman and an arm chair.

5 Claims, 10 Drawing Sheets

FURNITURE MADE OF FOLDABLE MATERIALS

The present invention relates to furniture which is made by folding blanks of material, such as corrugated cardboard and the like, and in particular to an ottoman and armchair formed from corrugated cardboard.

BACKGROUND OF THE INVENTION

Efforts have been made to make tables and the like from cardboard, and these efforts have resulted in tables and benches which can bear a substantial amount of weight. One example of a table or a bench constructed of foldable material is shown in U.S. Pat. No. 5,394,810.

Although the structure disclosed in U.S. Pat. No. 5,394,810 will be sturdy and have a planar upper surface usable as a table or bench, the structure is not sufficiently attractive to be usable by the general public as an item of furniture in a home. As a result, such furniture has primarily been used for utilitarian purposes, such as in trade shows and the like, where load bearing capacity is important, and aesthetic appearance is not.

Notwithstanding the above, inexpensive items of furniture having sufficient aesthetic value for use in the home are needed by individuals having either a limited budget or requiring use of the furniture for a short period of time. It would be desirable, therefore, to provide furniture, such as an armchair and ottoman, which can be assembled from foldable, precut corrugated cardboard or the like.

SUMMARY OF THE INVENTION

Briefly, the present invention is foldable furniture constructed of a plurality of blanks of stiff, foldable material, such as cardboard or corrugated board. The furniture may be configured as either an ottoman or armchair.

The weight bearing portion of the furniture includes a structure formed from at least one blank of foldable material which, when assembled, is a generally rectangular, three-dimensional member having a top, back, height and defines parallel opposite sides. Although blanks of material can be folded into several configurations to obtain a generally rectangular three-dimensional member, in the preferred embodiment, the member includes a first rectangular blank having a pair of parallel long sides and a pair of opposing ends. Positioned on opposite sides of a central portion of the first blank are a pair of scorings perpendicular to the long sides to define a top portion, and between each of the first scorings and the adjacent end of the first blank are second scorings, thereby forming a first and second side sections extending from opposite sides of the top portion. The scorings as described herein are to facilitate the folding of the blank and, therefore, the term "scoring" means any suitable process which renders the material more readily foldable along the line designated as a scoring. The term includes indentations, perforations, scratchings, pre-foldings and shallow cuts in the surface of the material.

The first and second side sections each have cutout portions, and the side sections are sized such that they can be folded with one surface of the second side sections abutting each other in side-by-side relationship with the ends of the blank positioned under the centerline of the top portion to provide support. When the second side sections have their surfaces abutting as described above, the first side sections are sloped towards each other, joining opposite sides of the top portion at their upper ends, and adjacent each other at their lower ends. The first blank further includes cutout portions for receiving a rectangular pedestal to retain the blank in assembled relationship with the top horizontal when the pedestal is positioned on a floor, and the long sides of the first blank defining opposing parallel sides of a three dimensional member.

In accordance with the present invention, extending from each of the second side portions of the first blank are opposing first tabs, each of which has a base and a distal end, and a slot extending into each base as an extension of the adjacent long side thereof.

To construct an ottoman in accordance with the present invention, a second blank is required. The second blank is divided into three panels, including a center panel flanked by first and second side panels, with the panels separated by scorings to facilitate the folding thereof. The panels are sized to fit with the central panel across the top of the assembled three dimensional member with the side panels extending across the opposing sides thereof.

The two side panels of the second blank each have a first slot for receiving the tabs extending from the associated opposing side of the three dimensional member, and spaced from the first slot is a second slot for receiving the distal end of each of the tabs. The second blank is, therefore, retained across the top of the three-dimensional member with the side panels extending along each of the opposing sides thereof by the tabs projecting through the first slots with the distal ends thereof extending into the second slots.

To configure the invention as an armchair, the second blank comprises a rectangular center panel, first and second rectangular side panels positioned on opposite sides of the central panel, and a back panel extending from one of the two remaining sides of the center panel. The center panel of the second blank is sized to fit across the top of the three dimensional member with the first and second side panels extending along the opposing sides thereof as was the case with the ottoman.

The three dimensional member provides the weight bearing structure beneath the seat of the chair with the parallel opposing sides defining sides of the chair and one of the sides perpendicular to the parallel opposing sides defining the back of the chair.

The armchair further includes a third blank which has a center panel and first and second side panels positioned on opposite sides of the center panel. The third blank is positioned with the planes of the surfaces thereof extending vertically, and when in this orientation the heights of the center panel and the side panels thereof are greater than the height of the three-dimensional member. The center panel is then positioned against the back of the three-dimensional member and the first and second side panels are positioned over the outer surfaces of the first and second side panels of the second blank and are retained in place by any appropriate means such as the first tabs which retain the second bank to the three dimensional member. Since the center portion of the third blank has a height greater than the height of the three dimensional member, it will retain the back portion of the second panel in the elevated position, thereby providing a back to the armchair.

Each of the side panels of the third blank has a first rectangular portion which is fitted against one of the opposing parallel sides of the three-dimensional member, and positioned above each of the first portions is a second rectangular side portion, and above each of the second side portions is a third rectangular side portion, with the sections of the panel separated by scorings. Extending from the upper end of each of the third rectangular side portions is a second tab.

When the third blank is assembled with the inner surfaces of the side portions positioned against the outer surfaces of the side portions of the second blank, and the side panels are folded along the scorings with the second portions positioned substantially horizontal to form the upper surfaces of the arms of the chair. The third portions of each side panel are folded downward with the second tabs at the ends thereof inserted in slots in the surface of tabs extending from the center panel of the second blank to retain the outer ends of the third rectangular portions against the sides of the first rectangular portions.

BRIEF DESCRIPTION OF THE DRAWING

A better understanding of the present invention can be had by a reading of the following detailed description taken in conjunction with the accompanying drawings wherein.

DETAILED DESCRIPTION OF A PREFERRED EMBODIMENT

Figure 1:
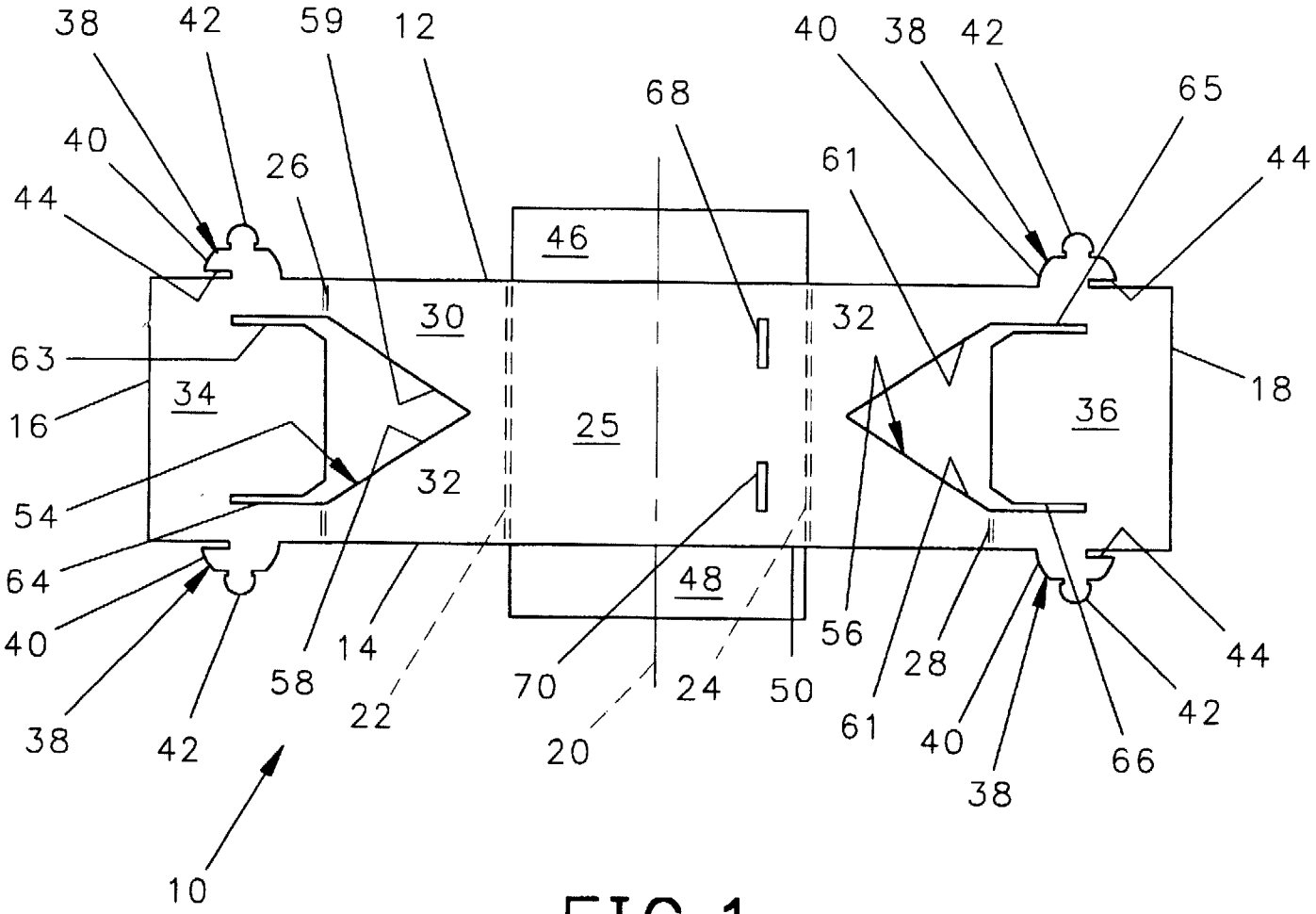
FIG. 1 is a front elevational view of a first blank in accordance with the present invention.

To assemble a piece of furniture suitable for bearing a load and having certain aesthetic qualities, a load bearing, three-dimensional rectangular member is required. Referring to FIG. 1, to construct a load bearing, rectangular, three-dimensional member, a first blank 10 is provided. The first blank 10 has parallel long sides 12, 14 and perpendicular outer ends 16, 18. Extending transverse to the length of the blank 10 and parallel to the long sides 14, 16, on opposite sides of the center line 20 thereof are parallel first scorings 22, 24 such that the sides 14, 16 and scorings 22, 24 define a top portion 25. Between the first scorings 22, 24 and the outer ends 16, 18, respectively, are a pair of second scorings 26, 28, respectively, which divide the expanse between the first scorings and the outer ends into first side sections 30, 32, and second side sections 34, 36, respectively. As previously stated, the scorings 22, 24, 26, 28 are intended to simplify the folding of the blank into sections and, therefore, the word "scorings" includes any alterations to the blank to simplify folding.

Extending from the long sides 12, 14 of the panel, adjacent the side sections 34, 36 are tabs 38 each of which has a widened base portion 40 and an elongate distal end 42. Extending into the base portion 40 from the outer ends 16, 18 and aligned with the associated sides 12, 14 of the blank 10 are short slots 44.

When manufactured, the blank 10 includes rectangular side portions 46, 48 extending from the portions of the sides 12, 14 adjacent the top 25. The demarcation lines 50, 52 between the top 25 and the side sections 46, 48 are perforated such that the side portions can easily be removed and discarded. For shipping purposes, the blank 10 is folded along the scoring 22, 24, 26, 28. When the folded blank 10 is inserted into a box, the side portions 46, 48 will be positioned against the ends of the box to thereby protect the distal ends of the tabs 38 from being damaged during shipment. Once the box is opened and the blank 10 unfolded, the side portions 46, 48 can be torn off along perforated lines 50, 52 and discarded.

The first panel 10 further includes two opposing symmetrical cutout portions 54, 56. Each of the cutout portions 54, 56 are generally triangular in shape with one edge being defined by portions of the second scorings 26, 28 and the remaining two sides by converging edges 58, 59, 60, 61. Each of the cutout sections 54, 56 further has a pair of elongate slots 63, 64, 65, 66 extending into the second side sections 34, 36, respectively, parallel to the long sides 12, 14. Where the first panel is to be used to form an armchair, a pair of in-line slots 68, 70 are positioned in the top section 25 near the second scoring line 24 and parallel thereto.

It should be appreciated that all the slots described herein are intended to interlock with or receive another portion of foldable material and, therefore, all of the slots must have sufficient width to accept a piece of material of which the blank is manufactured.

Figure 2:
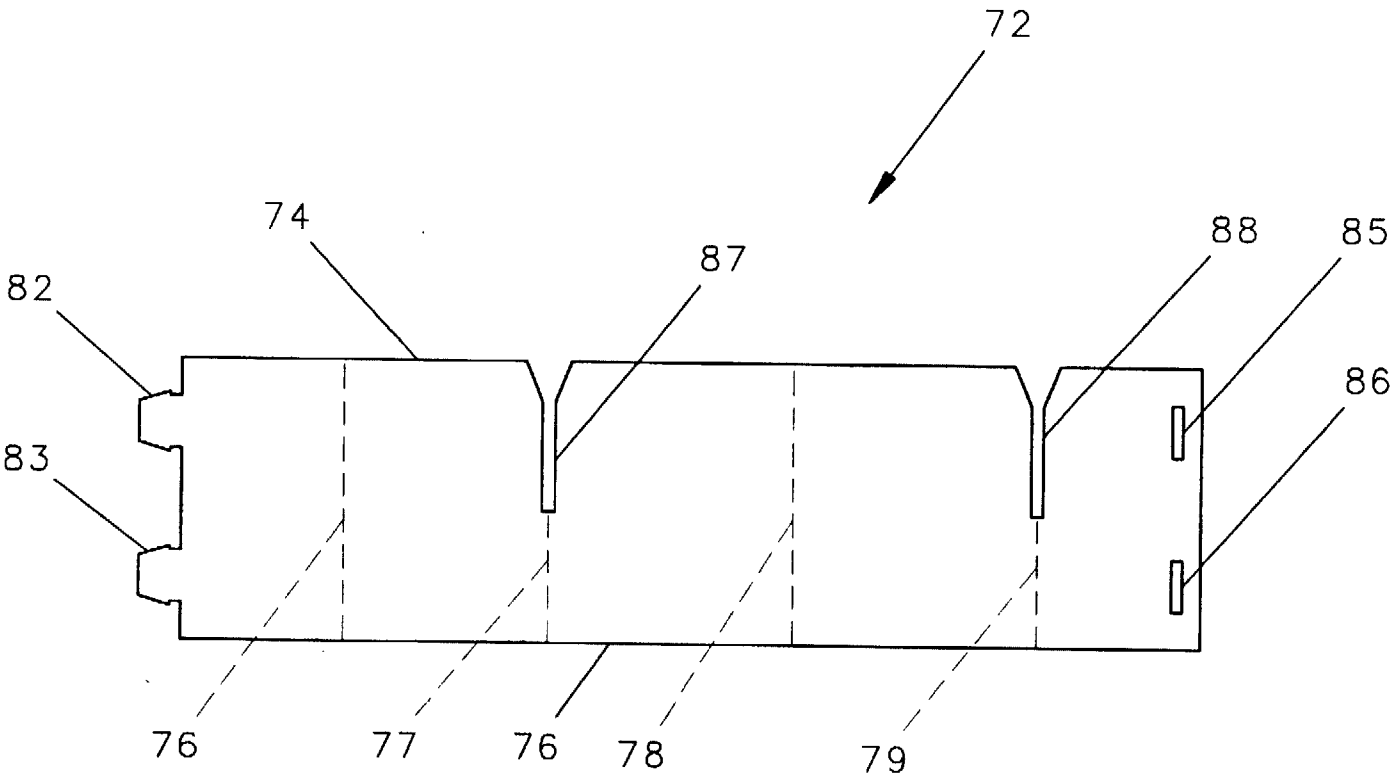
FIG. 2 is a front elevational view of a disassembled pedestal to be inserted into the assembled first blank to form a generally rectangular three-dimensional member.

Referring to FIG. 2, to assemble the first blank 10 into a three-dimensional member, a pedestal blank 72 is required. The pedestal blank 72 is generally rectangular in shape with elongate sides 74, 76 and transverse scorings 76, 77, 78, 79 such that the blank 72 can be folded along the scorings and assembled into a generally rectangular pedestal. At one end of the blank 72 are a pair of elongate tabs 82, 83 and at the other end of the blank 72 are a pair of slots 85, 86 sized and oriented to receive the tabs 82, 83 when the panels thereof are folded on the scorings 76, 77, 78, 79 into a rectangular pedestal. Extending into the blank 72 from the upper side 74, perpendicular to the sides 74, 76 and along two scorings 77, 79, which are not adjacent to each other, are open ended slots 87, 88.

Figure 5:
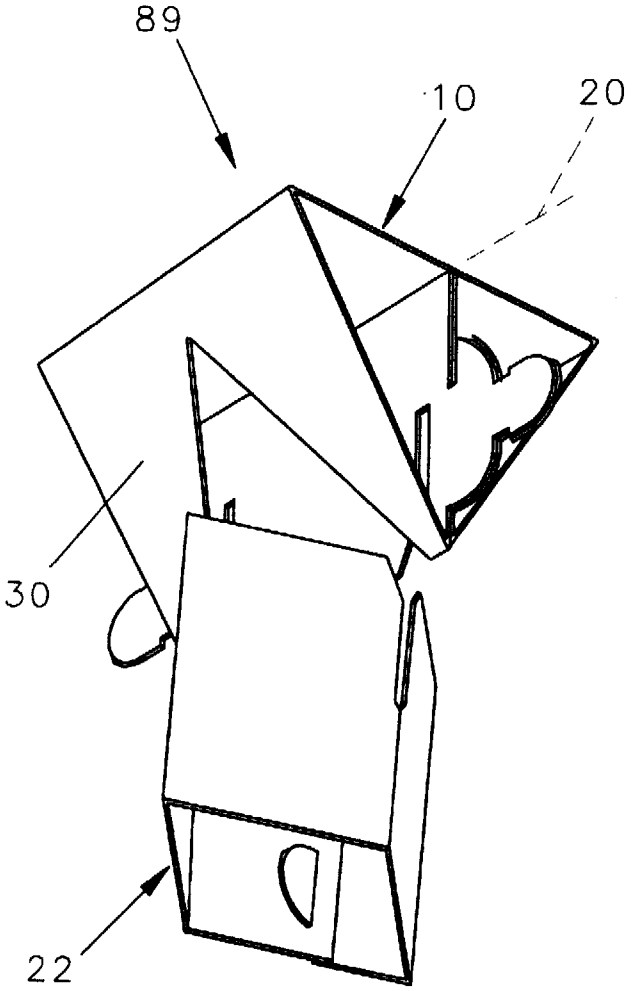
FIG. 5 is an isometric view of the folded first blank with the pedestal of FIG. 2 being assembled thereto.
Figure 4:
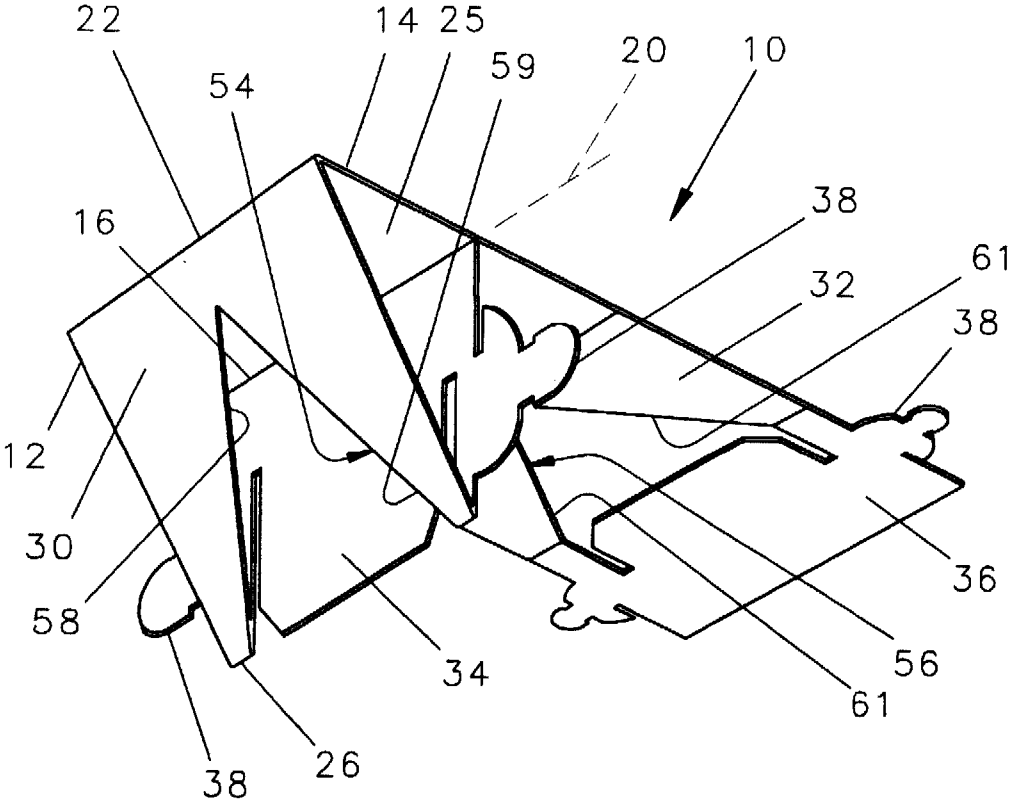
FIG. 4 is an isometric view of the first blank of FIG. 1 partially assembled.

Referring to FIG. 4, the blank 10 is folded into a three-dimensional figure by folding it along on the scorings 22, 24, 26, 28 such that the outer surfaces of the second side sections 34, 36 abut against each other with the outer ends 16, 18 positioned below the centerline 20 of the top 25 as shown. In this orientation, the cutout sections 54, 56 will mate to form a generally rectangular opening to receive the pedestal of blank 72 as shown in FIG. 5, and thereby form a three dimensional member 89.

Figure 3:
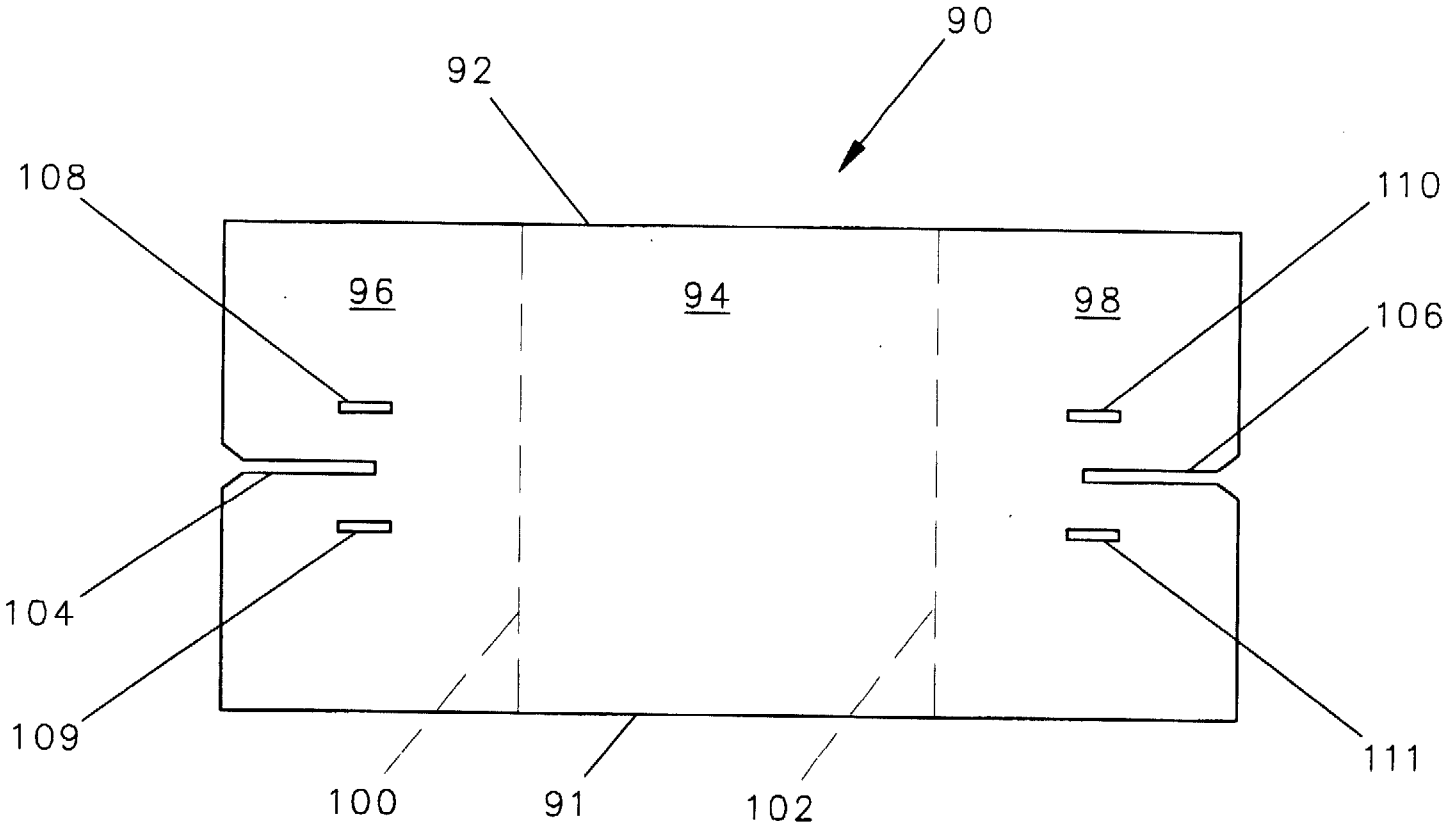
FIG. 3 is a front elevational view of a second blank suitable for assembly over the three dimensional member to form an ottoman.
Figure 6:
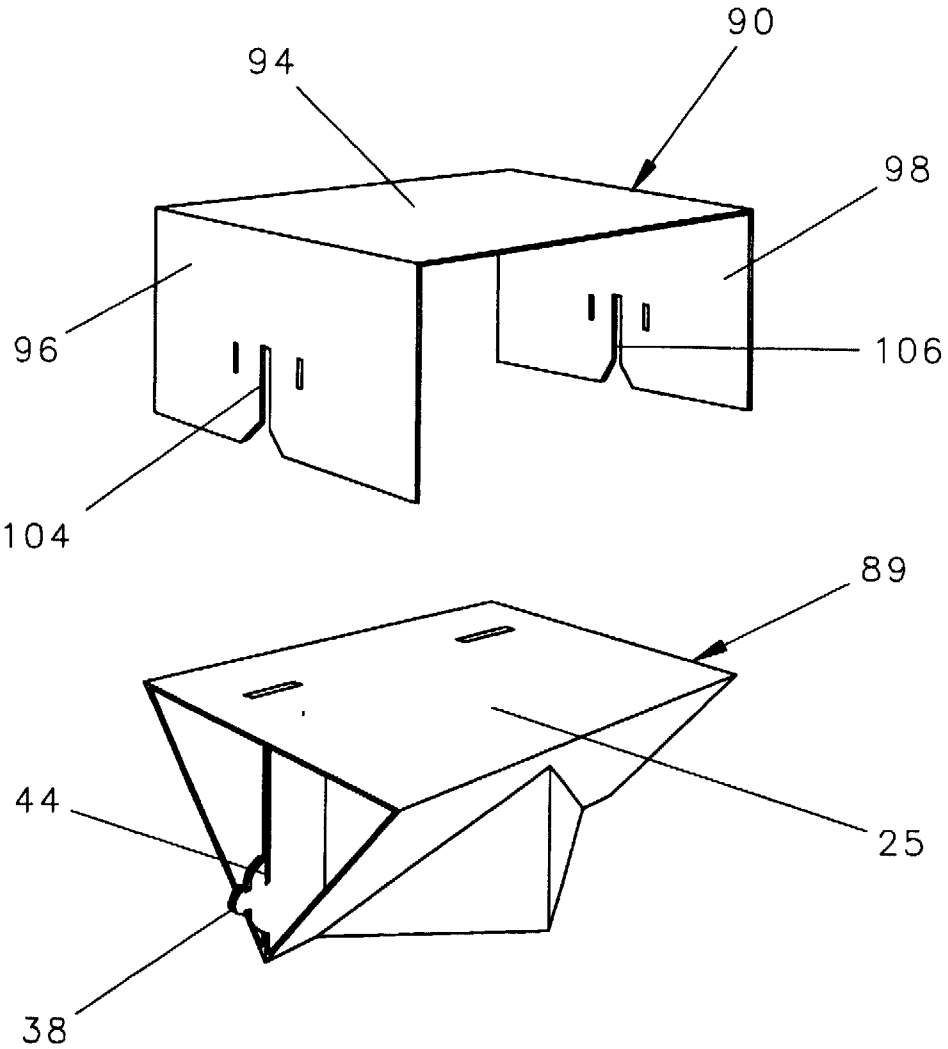
FIG. 6 is an isometric view of the second blank of FIG. 3 being assembled over the three-dimensional member formed by the first blank as shown in FIG. 5.
Figure 7:
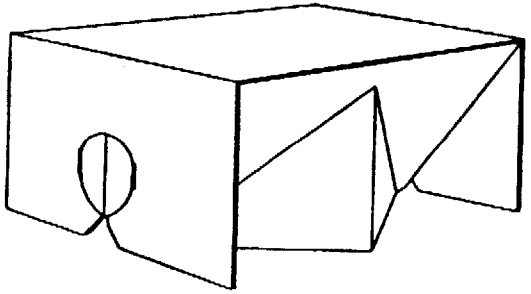
FIG. 7 is an isometric view of an assembled ottoman.

Referring to FIGS. 3, 6 and 7, to form an ottoman in accordance with the present invention, a second blank 90 is provided. The second blank 90 has parallel sides 91, 92, and is divided into a center panel 94 and opposing first and second side panels 96, 98, respectively. Between the center panel 94, and the first and second side panels 96, 98 are scorings 100, 102 to facilitate the folding of the blank into the three separate panels.

Extending into the first side panel 96 from the outer end thereof is a first open ended slot 104 and extending into the second side panel 98 from the outer end thereof is a second open ended slot 106. Finally, spaced on opposite sides of the inner ends of each of the slots 104, 106 are parallel slots 108, 109, 110, 111.

Referring to FIGS. 6 and 7, to assemble the second blank 90 to the three-dimensional member 89, the center panel 94 is positioned with the surface thereof against the surface of the top 25 of the three dimensional member 89 and the side panels 96, 98 are positioned against parallel sides thereof which are defined by the long sides 12, 14. Each of the tabs 38 which extend from the sides of the three dimensional member will interlock with one of the slots 104, 106. The slots 104, 106 have a length such that the inner end thereof will slide within the slot 44 of the tabs 38 to thereby prevent movement of the second blank 90 with respect to the three dimensional member 89. The panels are retained in assembled relationship by folding the tabs 38 against the surface of the side panels 96, 98 and inserting the distal ends 42 of the tabs 38 in the slots 108, 109, 110, 111, as shown in FIG. 7, to form an ottoman.

An alternate embodiment of the second blank plus a third blank are required to configure the invention as an armchair. The alternate second blank and the third blank are used with the same three-dimensional member described with respect to the first embodiment, and the indicia numbers relating to the three dimensional member as previously described are used with respect to the armchair embodiment.

Figure 8:
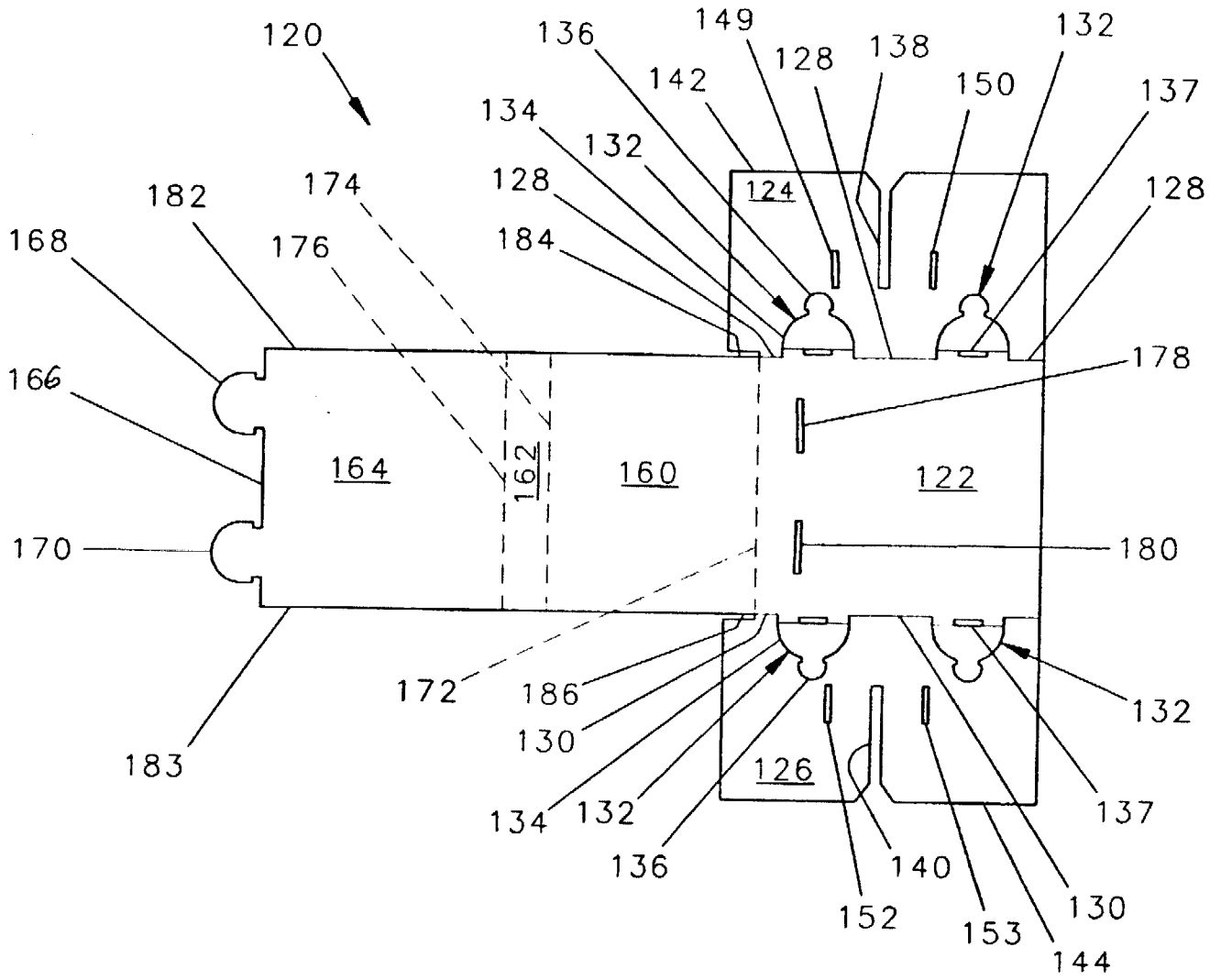
FIG. 8 is a plan view of a second blank suitable to form an armchair.

Referring to FIG. 8, an alternate second blank 120 has a generally square shaped center panel 122 having side dimensions substantially equal to the dimensions of the top 25 of the three dimensional member 89. Extending from opposite sides of the center panel 122 are a first side panel 124 and a second side panel 126, and between the center panel 122 and the side panels 124, 126 are scorings 128, 130, respectively.

As can be seen in FIG. 8, the scorings 128, 130 do not extend across the entire width of the junction between the center panel 122 and the adjacent panels 124, 126, but are broken to accommodate connector tabs 132 cut out of the adjacent side panels 124, 126. Each of the tabs 132 has a widened base portion 134 and an elongate distal end 136. In the preferred embodiment, two tabs 132 are cut into the first side panel 124, with the bases 134 thereof aligned along the first scoring 128, and two tabs 132 are cut into the second side panel 126 with the bases 134 thereof aligned along the second scoring 130. Extending across the base 134 of each of the tabs 132 is a transverse slot 137 which is oriented parallel to and adjacent the scoring 128 or 130 but offset outwardly therefrom. Each of the first and second side panels 124, 126 has an open ended slot 138, 140 extending from the outer edge 142, 144 thereof, respectively.

Centrally located within side panel 124, and positioned parallel to and on opposite sides of the inner end of the open ended slot 138 are adjacent slots 149, 150. Similarly, centrally located in the second side panel 126, on opposite sides of the inner end of the open ended slot 140 is a second pair of spaced parallel slots 152, 153.

Extending from the center panel 122 in a direction perpendicular to the first and second side panels 124, 126 is a generally rectangular back panel 160. On the opposite side of the back panel 160 and extending away from the center panel 122 is an upper end panel 162, and positioned outward of the upper end panel 62 is a cushion panel 164. Finally, extending outward of the outer edge 166 of the cushion panel 164 are a pair of tabs 168, 170. Separating panels 122, 160, 162, 164 are scorings 172, 174 and 176 to facilitate the folding of the material as previously described.

The center panel 122 further has a pair of longitudinally aligned slots 178, 180 extending parallel to the scoring 172 separating the center panel 122 from the back panel 160, but offset therefrom. Also, extending along a portion of scoring 128, 130, and aligned with the sides 182, 183 of back panel 160, 162, 164, respectively, are another pair of open ended slots 184, 186.

Figure 10:
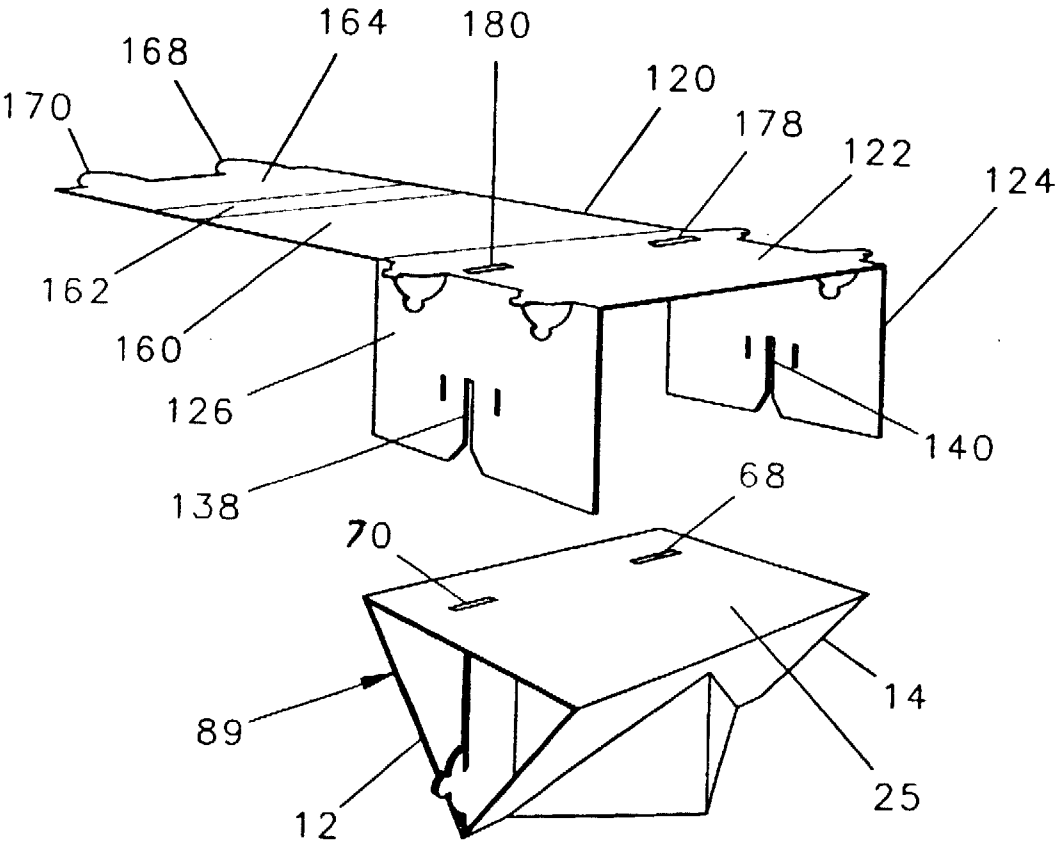
FIG. 10 is an isometric view of the assembly of the second blank o FIG. 8 to the three-dimensional member shown in FIG. 5.

Referring to FIG. 10, to assemble the alternate second panel 120 to the three-dimensional member 89 the central panel 122 is fitted across the upper surface of the top 25 of the three dimensional member 89 and the first and second side panels 124, 126 are folded downward to butt against the parallel sides defined by the outer edges 12, 14 with the open ended slots 138, 140 engaging the notch 44 in the base of the tabs 38 as was the case in the first embodiment. The back panel 160 is folded upward relative to the center panel 122 along scoring 172 and the cushion panel 164 is folded on scorings 174, 176 in front of the back panel 160 as shown. Thereafter, the tabs 168, 170 are inserted through the in-line slots 178, 180 in the center portion of the alternate second blank and through the aligned slots 68, 70 in the top 25 of the three-dimensional rectangular members 89.

Figure 9:
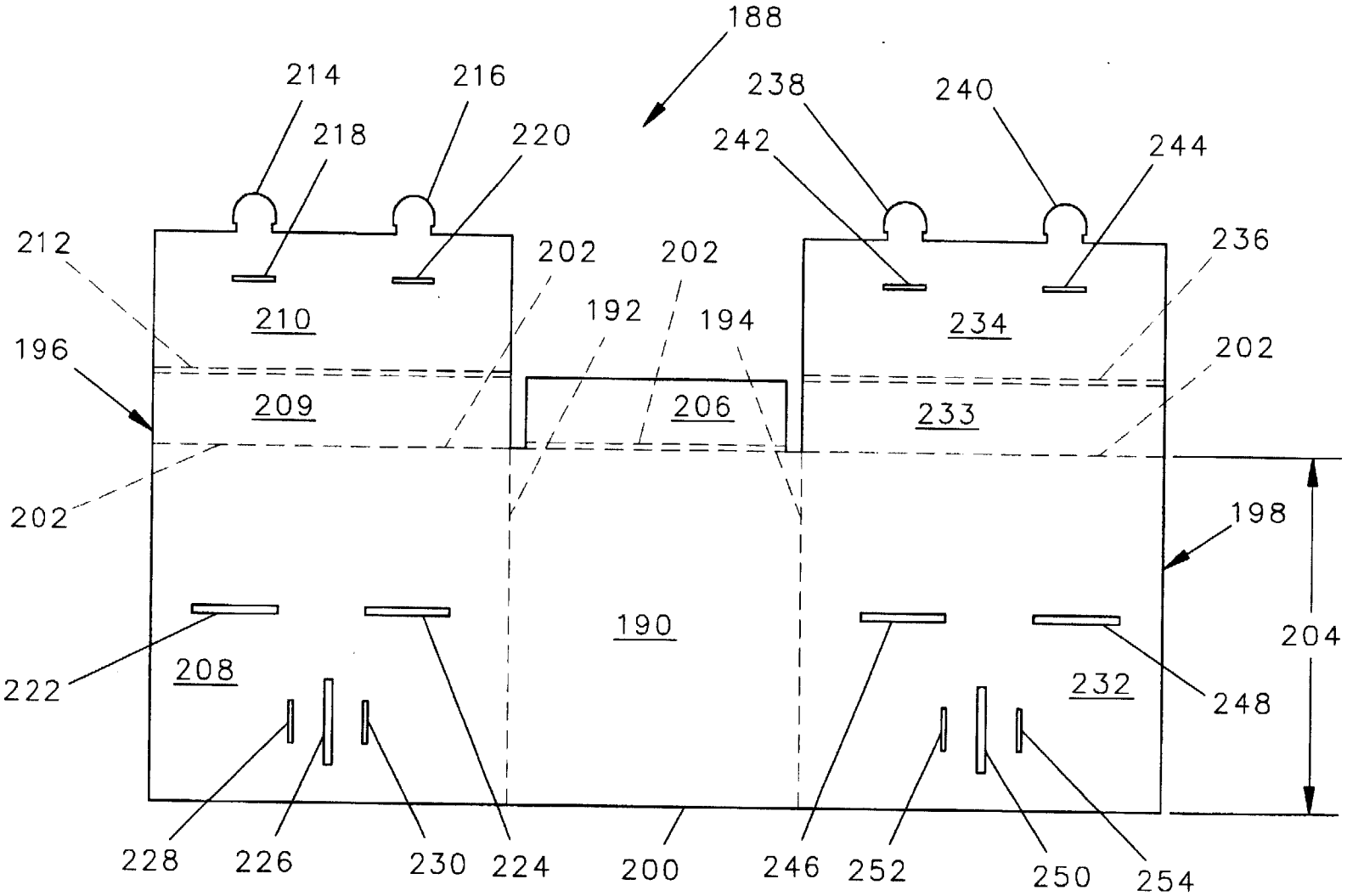
FIG. 9 is a plan view of a third blank for use with the second blank shown in FIG. 8 and the three-dimensional member shown in FIG. 5 to form an armchair.

Referring to FIG. 9, the chair embodiment further has a third blank 188 having a central portion 190 bordered on its sides by scorings 192, 194. Positioned outward of the center portion 190 and joined at the scorings 192, 194 are first and second side panels 196, 198.

The third blank 188 is adapted to fit around the back and sides of the constructed chair, as further described below and, therefore, the center portion 190 and first and second side panels 196, 198 have a common bottom side 200 which rest against the floor with the panels 190, 196, 198 extending vertically. The upper boundaries of the adjacent panels 190, 196, 198 are bounded by a scoring 202 which extends across all three panels as shown. The height 204 of the adjacent panels 190, 196, 198 is greater than the height of the top 25 of the three-dimensional member 89 and is chosen to provide comfortable height for the arm rests for one seated on the chair as further described below. Extending upward from the central panel 190 is an elongate rectangular flap 206.

The first side panel 196 is divided into three rectangular portions positioned one above the other. The lowermost is the first side portion 208 which, when assembled into a chair, will define the lower side thereof. Above the first side portion 208 is a first arm rest portion 209, and above the first arm rest portion 209 is a first outer support portion 210. The portions 208, 209, 210 are separated from one another by scorings 202 and 212 as shown.

Extending from the upper end of the first outer support portion 210 are two tabs 214, 216, and inward of the tabs 214, 216 are slots 218, 220. Centrally located in the first side panel 96 are horizontally aligned slots 222, 224 oriented parallel to the bottom side 200. Below the slots 222, 224 and oriented perpendicular to the bottom side 200 is a third slot 226, and on opposite sides of the third slot 226 and spaced therefrom are smaller slots 228, 230.

The second side panel 198 is configured complementary to the first side panel 196 and includes a second side portion 232, a second arm rest portion 233 and a second outer support portion 234 with the portions separated by scorings 235, 236, as shown. Tabs 238, 240 extend upward of the upper end of the second outer portion 234, and inward of the tabs 238, 240 are longitudinally aligned slots 242, 244.

Like the first side panel 196, the second side portion 232 also has centrally located horizontally aligned slots 246, 248 below which is a vertically oriented slot 250. Spaced on opposite sides of the vertically oriented slot 250 are smaller slots 252, 254.

Figure 11:
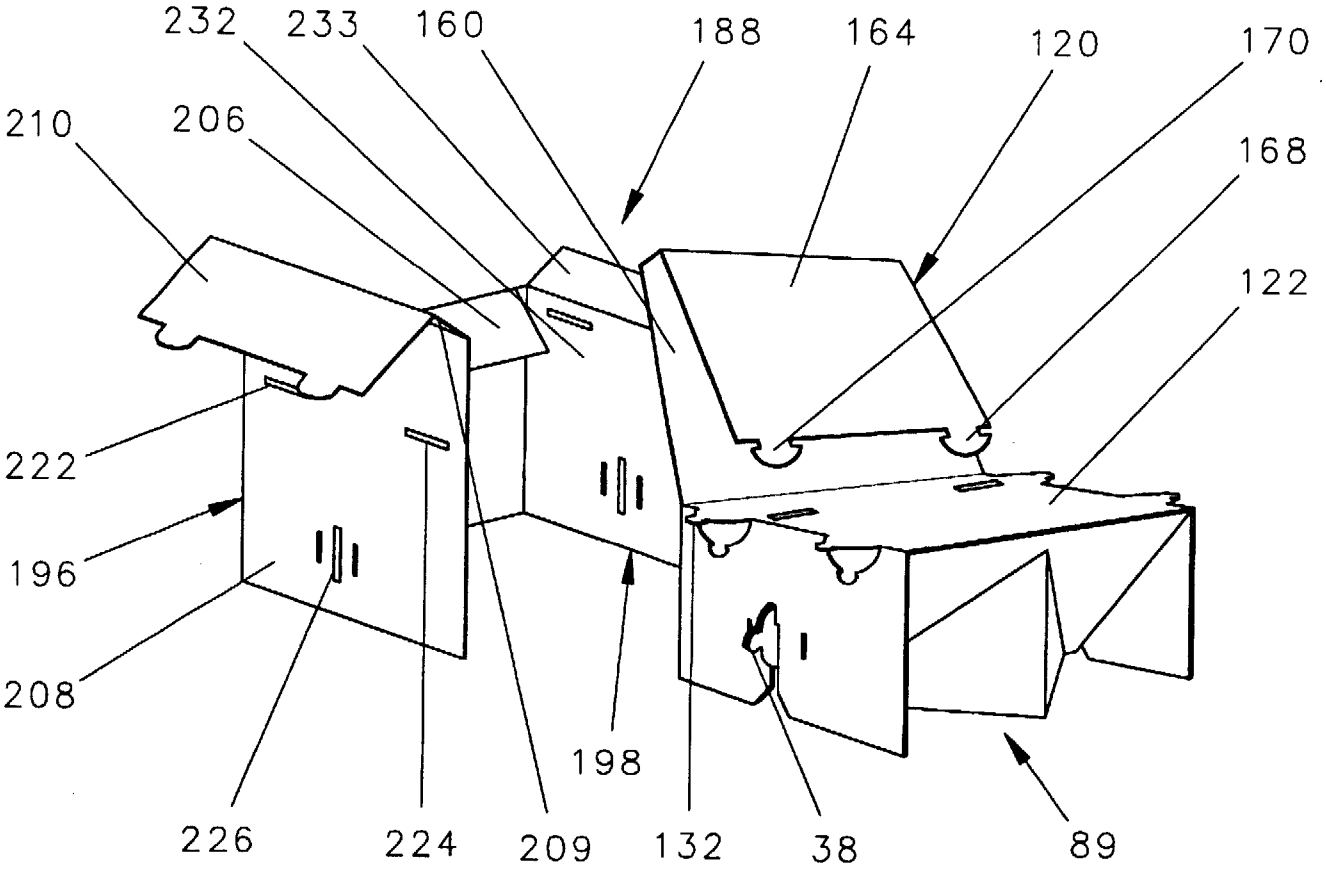
FIG. 11 is an isometric view of the assembly of the third blank FIG. 9 with the second blank of FIG. 8 and the three dimensional member.
Figure 13:
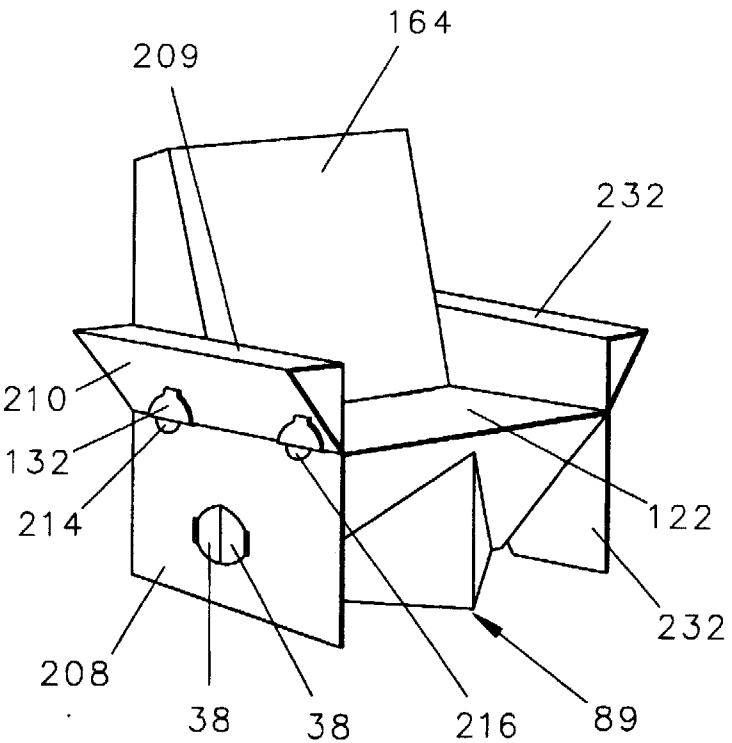
FIG. 13 is an isometric view of an assembled armchair.
Figure 12:
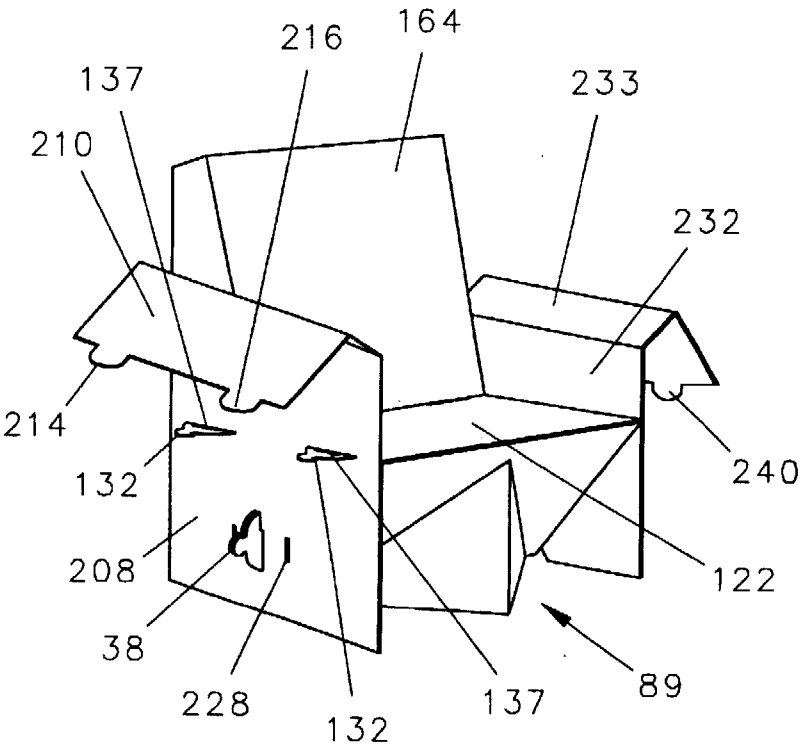
FIG. 12 is an isometric view showing further assembly of the second and third blanks to the three dimensional member.

Referring to FIGS. 11, 12, 13 to assemble the third blank 188 around the assembly of the second blank 120 and the three-dimensional member 89, the third blank 188 is positioned vertically with the bottom side 200 against the ground. The first and second side panels 196, 198 are folded along the scorings 192, 194 to a position where they are parallel to each other and perpendicular to the central portion 190. The flap 206 is folded between the parallel side panels 196, 198. The horizontally aligned slots 222, 224 in the first side panel 196 are aligned to receive the tabs 132 extending from one side of the center portion 122 of the second blank 120 and the horizontal slots 246, 248 of the second panel 198 are positioned to receive the tabs 132 extending from the opposite side of the center portion 122 as shown in FIG. 12.

The first arm rest panel 209 and first outer support panel 110 are folded along scores 202 and 212 with the tabs 214, 216 inserted into the transverse slots 137 in the base of the tabs 132 as shown. Similarly, the second arm rest panel 233 and second outer support panel 234 are folded along scorings 202 and 236 with the tabs 238, 240 inserted into the transverse slots 137 in the tabs 132 on the opposite side of the chair. Finally, as shown in FIG. 13, the distal ends 136 of the tabs 132 are inserted into the slots 218, 220, 242, 244 to thereby retain the first and second outer support panels 210, 234 in place such that the first and second arm rest panels 209, 233 will bear the weight of the arms of one seated in the chair.

There is, therefore, disclosed an armchair which can be assembled from panels of foldable material. A noteworthy feature of the armchair as described is that the cushion panel 164 is a little longer than the back panel 160 and when assembled into a chair, the cushion panel 164 will be bowed to thereby form a cushion against which one can rest his back when seated in the chair.

While the present invention has been described in connection with two embodiments, it will be understood that many changes and modifications may be made without departing from the true spirit and scope of the invention, and it is intended by the appended claims to cover all such changes and modifications which come within the true spirit and scope of the invention.

What is claimed:

1. A plurality of blanks of stiff foldable material for assembly into a chair comprising in combination, at least one foldable blank to form a generally rectangular three dimensional member having a top, a back and defining opposing parallel sides, a second blank comprising a center panel, a first side panel, a second side panel, and a back panel, each of said first side panel, said second side panel and said back panel joining along a side thereof to a side of said center panel, said second blank having scorings between said panels thereof, said center panel of said second blank sized to fit across said top of said three dimensional member with said first side panel and said second side panel of said second blank along said opposing parallel sides of said three dimensional member, a third blank comprising a center panel, a first side panel and a second side panel, said center panel, said first side panel and said second side panel of said third blank having heights greater than the height of said three dimensional member, means for retaining an inner surface of said first side panel of said second blank against one of said opposing sides of said three dimensional member, means for retaining an inner surface of said first side panel of said third blank against an outer surface of said first side panel of said second blank, means for retaining an inner surface of said second side panel of said second blank against the other of said opposing sides of said three dimensional member, means for retaining an inner surface of third side panel against an outer surface of said second side panel, whereby said center panel of said third blank will maintain said back panel of said second blank in an elevated orientation to form a chair with said top of said three dimensional member forming a seat and said elevated back panel of said second blank forming the back thereof.

2. A plurality of blanks of stiff foldable material for assembly into a chair having arms comprising, at least one blank foldable to form a three dimensional member having a top, a back and defining rectangular opposing parallel sides, a first tab extending outward of said three dimensional member, said first tab orientable in a plane substantially coplanar with a plane of said top of said three dimensional member, and extending from one of said opposing sides thereof, said first tab having a length, a base, a width, and a distal end, and having a slot in said base transverse to said length thereof, a second blank having a side panel having a first portion, a second portion adjoining one side of said first portion, and a third portion adjoining a side of said second portion opposite said first portion, scoring between said portions of said side panel of said second blank to facilitate folding of said side panel between said portions, a second tab extending from a side of said third portion opposite said side joined to said second portion, said second tab having a length, width, and a distal end, said first portion having a height greater than the height of said three dimensional member and having a slot therein for receiving said first tab when said first portion is positioned against one of said opposing sides of said three dimensional member, and said slot in said base of said first tab for receiving said second tab whereby said third portion and said second tab will retain said second portion in a substantially horizontal orientation to form an arm of said chair.

3. A plurality of blanks of stiff foldable material for assembly into an item of furniture comprising:

at least one foldable blank to form a three dimensional member having generally rectangular opposing sides, and having a top, a back, and defining opposing parallel sides thereof, a second blank comprising a center panel and first and second side panels, said panels separated from each other by scorings to facilitate the folding thereof, said panels sized to fit said center panel and across said top of said three dimensional member and said side panels across said opposing parallel sides thereof, tabs extending from said opposing sides of said three dimensional member, said tabs having a base and a distal end, and each of said side panels of said second blank having a first slot for receiving one of said tabs, and a parallel second slot spaced from said first slot for receiving said distal end of said tab whereby said base of said tab extends through said first slot for retaining said second blank to said three dimensional member and said distal end of said tab extends into said second slot and is retained therein.

4. A plurality of blanks in accordance with claim 3 and further comprising, each of said tabs having an open ended slot in said base thereof, said open ended slot transverse to the length of said tab, said transverse slot for engaging one of said first side panel and said second side panel.

5. A plurality of blanks in accordance with claim 3 and further comprising, each of said tabs having a transverse open ended slot in said base thereof, each of said first side panel and said second side panel having an elongate open ended slot extending to a side of said panel of said blank, each of said side panel elongate slots for engagement with said, transverse slot in said base of one of said tabs when said panels of said second blank are folded around said three dimensional member.

* * * * *